US006736569B2

(12) United States Patent
Lee

(10) Patent No.: US 6,736,569 B2
(45) Date of Patent: May 18, 2004

(54) STRUCTURAL MODULAR INTERCONNECTABLE SUBSOIL DRAINAGE CELL

(76) Inventor: Alan Sian Ghee Lee, 21 Almond Crescent, Singapore 677779 (SG)

( * ) Notice: Subject to any disclaimer, the term of this patent is extended or adjusted under 35 U.S.C. 154(b) by 0 days.

(21) Appl. No.: 10/296,844

(22) PCT Filed: Jan. 2, 2001

(86) PCT No.: PCT/AU01/00001

§ 371 (c)(1),
(2), (4) Date: Nov. 26, 2002

(87) PCT Pub. No.: WO01/53608

PCT Pub. Date: Jul. 26, 2001

(65) Prior Publication Data

US 2003/0118404 A1 Jun. 26, 2003

(30) Foreign Application Priority Data

Jan. 17, 2000 (AU) ..... PQ5141

(51) Int. Cl.[7] ..... E02B 11/00

(52) U.S. Cl. ..... 405/50; 405/43; 405/45; 52/169.5

(58) Field of Search ..... 405/50, 43, 44, 405/45, 47; 52/169.5

(56) References Cited

U.S. PATENT DOCUMENTS 4,943,185 A * 7/1990 McGuckin et al. ..... 405/45
5,030,343 A * 7/1991 Urriola ..... 405/43
5,044,821 A * 9/1991 Johnsen ..... 405/50
5,692,348 A * 12/1997 Ambrosino ..... 52/169.5
5,857,297 A * 1/1999 Sawyer ..... 52/169.5
6,247,874 B1 * 6/2001 Hu ..... 405/43

FOREIGN PATENT DOCUMENTS

| | | |
|---|---|---|
| DE | 44 00 183 | 7/1995 |
| EP | 0 244 651 | 11/1987 |
| EP | 0 787 865 | 8/1997 |
| EP | 0 943 797 | 9/1999 |

* cited by examiner

*Primary Examiner*—Frederick L. Lagman
(74) *Attorney, Agent, or Firm*—Ladas & Parry

(57) ABSTRACT

A structural module comprises a rigid cell including two substantially parallel planar members, each of which defines an ordered array of circular apertures with a series of columns disposed substantially normally to the two parallel surfaces retaining the two members in a fixed spaced relationship from each other. Male interlocking means which are integral with the module project from two adjacent side edges of the module. Female interlocking means are defined the other two adjacent side edges. The modules can be secured together in side edge to side edge relation, in which relationship the male locking means from a first module engage in a female locking means of a second module. The circular shape of the perimeter of the male locking member matches the size and shape of the apertures so that one module may also be inter-engaged with a second module with each male locking member of the one module projecting into one of the apertures of the second module in an interference type fit, with the first module oriented generally normally to the second module.

14 Claims, 8 Drawing Sheets

STRUCTURAL MODULAR INTERCONNECTABLE SUBSOIL DRAINAGE CELL

FIELD OF THE INVENTION

This invention relates to an interconnectable structural module, particularly, but not exclusively, for use as a drainage module.

BACKGROUND OF THE INVENTION

The control and flow of surface water, such as rain water or storm water, is important in preventing the build up of surface water adjacent foundations of buildings or other structures, and in other areas such as on playing fields, golf courses, landscaped decks, gardens and the like. In densely built up areas, the increased surface run-off of storm and rain water has resulted in massive storm water channels being built to cope with the quantities of run-off water. However, these impervious drainage systems take up large areas of land and are not only an eyesore, but are expensive to build and maintain. Further, they are often polluted by sedimentation and organic rubbish. Storm water channels often smell offensive and can turn into major breeding grounds for pests and diseases.

One solution to this problem, has resulted in the invention of subsoil modular drainage systems such as the "NORDRAIN"™ subsoil modular drainage system (trade mark of Nortec Geo-Systems (S) Pte Limited of Scotts Road. #05-05 Singapore). The NORDRAIN system comprises a rigid cell including a first and a second substantially parallel planar member, each of which defines an ordered array of circular apertures with a series of columns which are disposed substantially normally to the two parallel surfaces retaining the two members in a fixed spaced relationship from each other. The circular apertures in the first and second planar members are out of register such that the centre of an aperture in the first member is generally opposed to a solid area of the second member disposed between four adjacent circular apertures in the second member.

Such sub-soil modular drainage systems create a permanent void between a building structure and the soil profile and thus allow easy passage of excess subterranean waters to designated outlets. They are also used in drainage applications for playing fields, golf courses and the like and for making underground storage tanks when they are assembled in a box structure and covered in geotextile.

FIG. 1 of the attached drawings illustrates the use of a NORDRAIN sub soil modular drainage system 3 against a retaining wall 1 to provide relief from hydrostatic pressure on that wall by channelling excess waters to an appropriate outlet. A waterproof membrane 2 is disposed between one face of the NORDRAIN module and the wall 1, and the other face of the NORDRAIN module is covered in a geotextile 4.

Such modules tend to be made to a particular, relatively small, size typically about 340 long×340 wide×30 mm deep and the modules are joined together to create larger drainage structures. Although the NORDRAIN and other similar subsoil modular drainage systems work well, sometimes problems arise in assembling the modules into an appropriately sized composite module sized for a particular application. This is often done using separate clips. Problems arise in particular where the modules are being used against a retaining wall in a generally vertical orientation.

It is an object of the present invention to provide an improved drainage module with improved means for assembling the drainage modules together.

SUMMARY OF THE INVENTION

According to the present invention, there is provided a structural module comprising:

a first and a second substantially parallel generally planar member retained in a fixed spaced relationship from each other by a plurality of spacers extending between the first and second planar members, the module having side edges extending between perimeters of the first and second planar members and wherein each planar member defines an ordered array of apertures;

male interlocking means which are integral with the module projecting from at least a first one of the side edges;

female interlocking means defined in at least a second of the side edges adapted to receive a male interlocking means so that two modules can be secured together in side edge to side edge relation;

characterised in that the size and configuration of the male locking means relative to the size and configuration of the apertures, is such that a first module may also be inter-engaged with a second module, with the first module oriented generally normally to the second module with a side edge of the first module abutting a planar member of the second module and with each male locking member defined along said side edge of the first member extending into one of the apertures defined in one of the planar members in a close or interference type fit with the aperture.

In a preferred embodiment, the female locking means comprise elongate slots defined between the ends of two walls, forming part of the side edges. The slots have an open end and a closed end. The male locking means may comprise two arms which are generally L shaped in cross section. When two modules are butt joined and interlocked in end to end relation the ends of the arms engage, behind the walls defining the slots.

The apertures are preferably generally circular.

It is preferred that the area of the apertures comprises at least 50% of the surface area of the first and second planar members.

It is preferred that the apertures in the planar members are arranged substantially regularly and uniformly.

In one particularly preferred embodiment, the male locking means equidistantly spaced along a first two adjacent sides of the module; the arrangement of male locking means along each adjacent side is asymmetric (i.e. offset). A series of gaps are disposed between each pair of male locking means. The female locking means are also equidistantly and asymmetrically spaced along the other two sides of the module. A series of gaps are also disposed between each pair of female locking means. The gaps are wider than the male members. The arrangement of male locking means, female locking means and gaps is such that when a module is abutted end to end with another module, with the tops of both modules facing up (or both facing down) the modules will interlock. In this arrangement the modules are butt joined and also interlocked. However, if one of the modules is turned around through 180° so that the sides having male interlocking means face each other, or if one of the modules is turned upside down relative to the other because of the asymmetry of the arrangement of the male locking means, the male locking means simply locate in some of the gaps and do not interlock the modules together. In this arrangement the modules are butt joined but not interlocked. Modules may also be butted and not interlocked by positioning together, sides having female interlocking means. The invention has the advantage over existing products in that it is not necessary to carefully align modules or clip them together.

In addition to use as a drainage cell, other possible uses for the module include, a drainage layer, a protection layer, a core for covered/uncovered panels, and when assembled as a box structure, as retention/detention tanks, table supports and the like. In addition, the modules may be used as channels/ducts for the flow of liquids, gases, solids having a small particle size, as a protection layer, as a separator, a panel for table tops, or as panels for doors or room partitions, exhibition stands, supports for other structures, or the like. Other uses which benefit from the modules manner of interlocking, fluid permeation characteristics and/or shear, compression and torsional strengths may be envisaged.

The module may be injection moulded in PP (polypropylene) HDPE (high density polyethylene) or LPDE (low density polyethylene). However, any other suitable materials which can be moulded or cast, may be used, including aluminum and rubber.

In a related aspect, to the present invention also encompasses the use of the nodule of the present invention, to make drainage piping or underground tanks by assembling and interlocking the modules into boxes or pipes and covering them with geotextile or the like.

BRIEF DESCRIPTION OF THE DRAWINGS

A specific embodiment of the present invention will now be described, by of example only, and with reference to the accompanying drawings ill which.

DETAILED DESCRIPTION OF A PREFERRED EMBODIMENT

Figure 2:
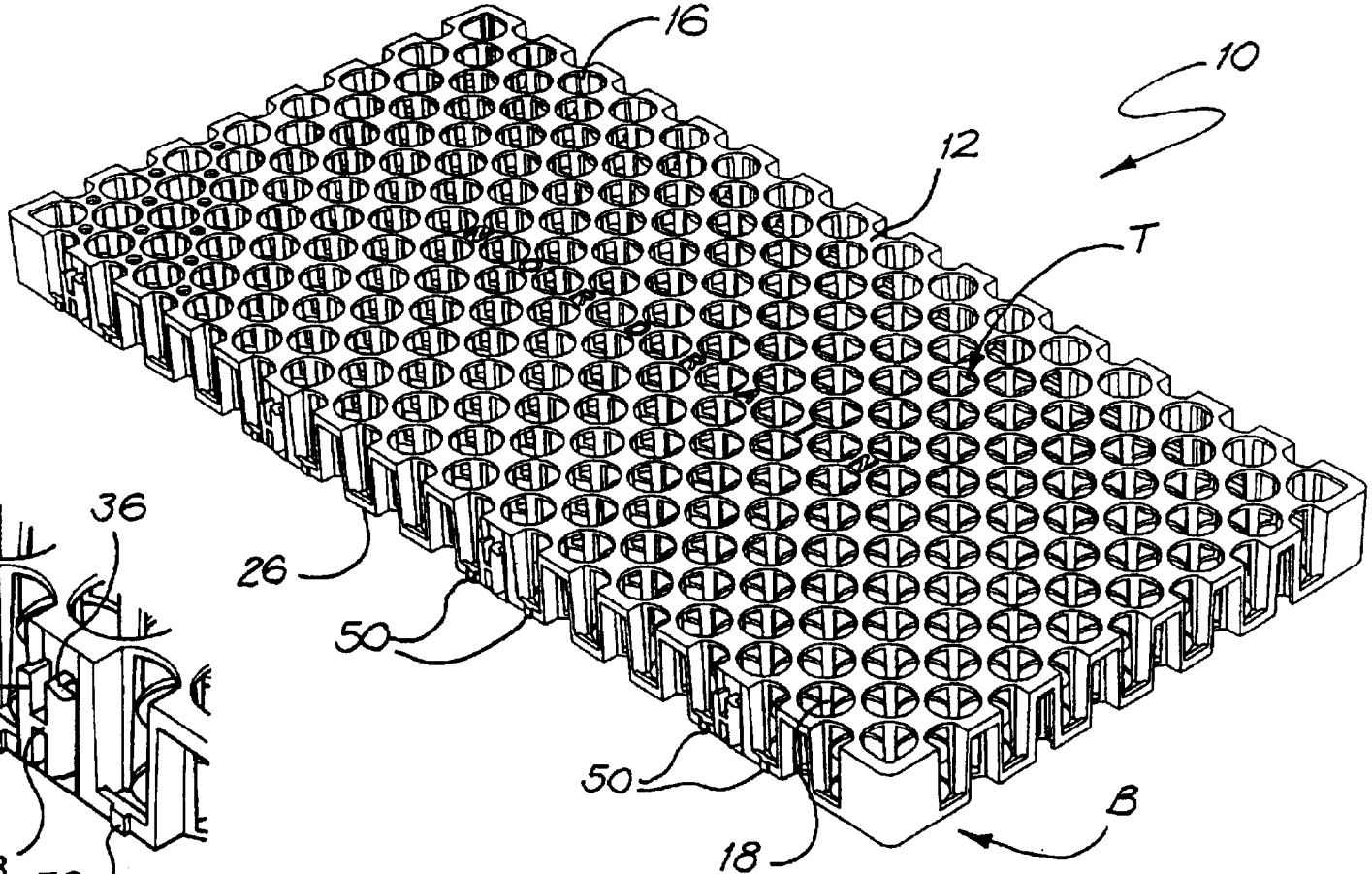
FIG. 2 is a perspective view from above and the front of a drainage module embodying the present invention.
Figure 3:
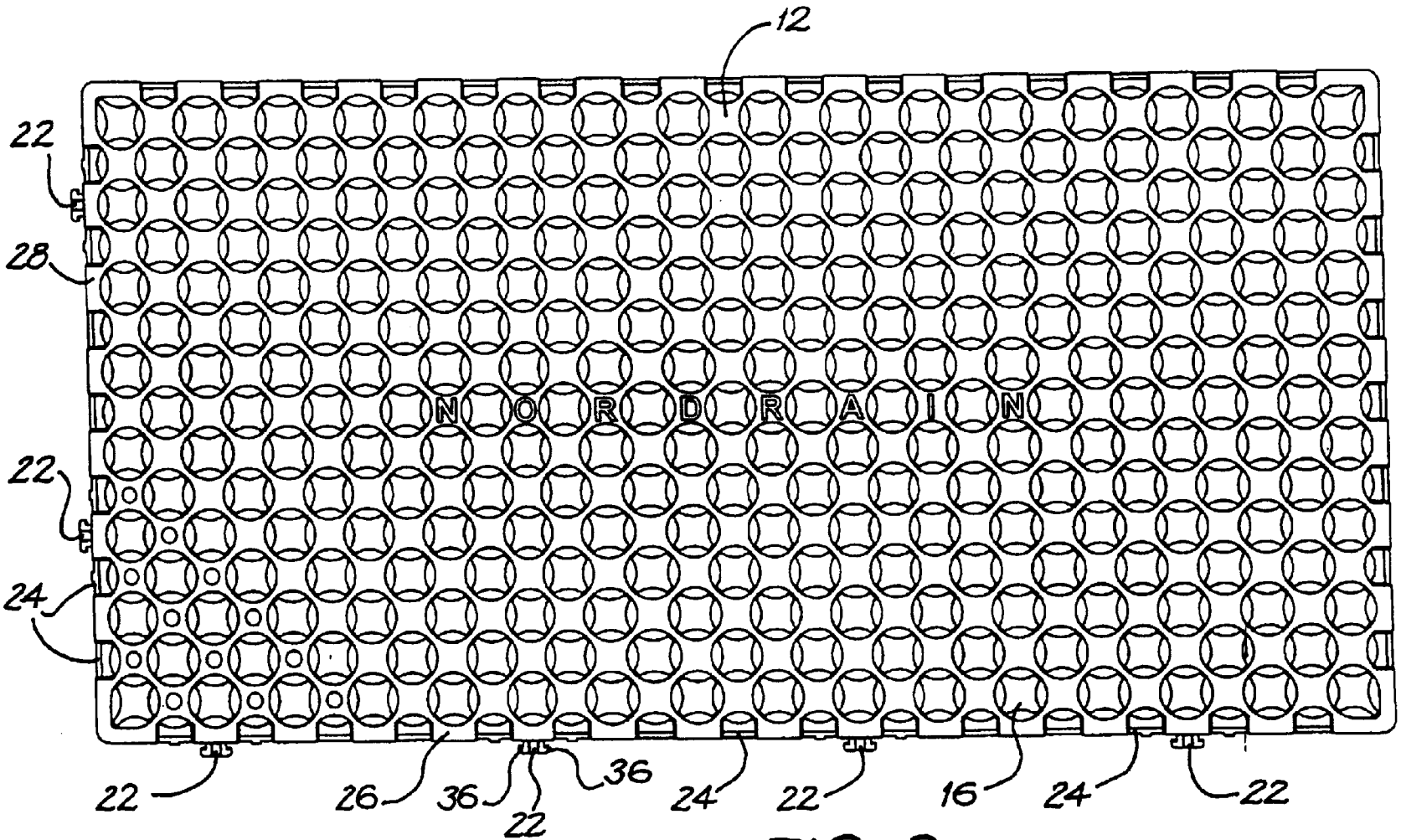
FIG. 3 is a top plan view of the module of FIG. 2.
Figure 4:
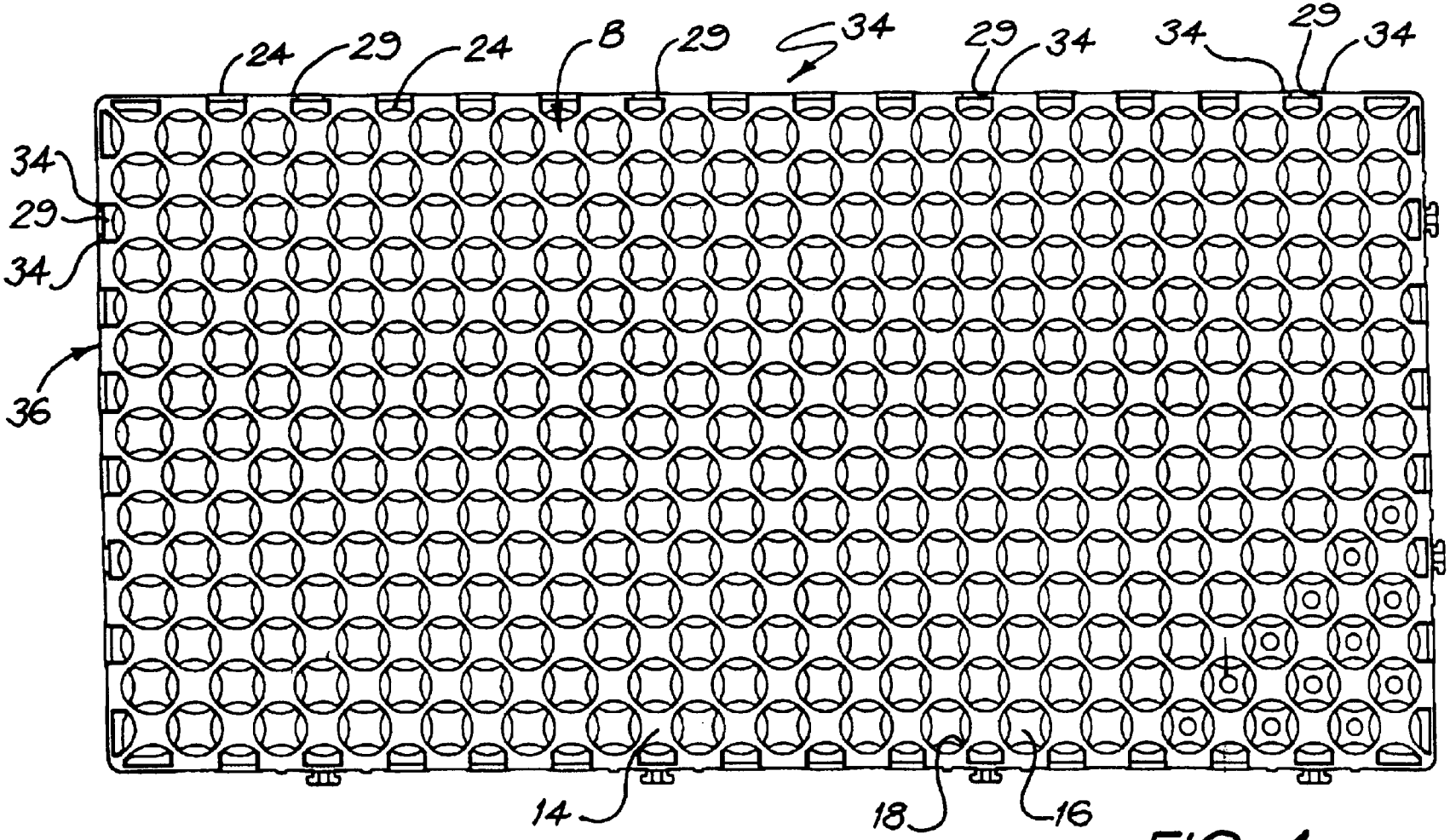
FIG. 4 is a bottom plan view of the module of FIG. 2.

Referring to the drawings. FIG. 2 shows a perspective view of a drainage module 10 embodying the present invention other views of which are shown in FIGS. 3 to 8. As shown in the Figures, the drainage module includes two planar members, an upper member 12 defining an upper face or top T of the module and a lower member 14 defining a lower face or bottom B. A regular and ordered array of circular apertures 16 are defined in both members. The size and spacing of the apertures is such that approximately 58% of the area of each of the planar members 12, 14 is open. The arrangement of the apertures on both of the planar members 12, 14 is substantially identical. However, as is best seen in FIGS. 3 and 4, the apertures in the upper member 12 are out of register with those in the lower member 14. A plurality of spacer elements 18 extend between the layers 12, 14 maintaining the layers in spaced apart parallel relationship. Four spacer elements 18 are located on the periphery of each circular aperture 16, spaced 90° apart.

The forming of the modules with the apertures out of register, enables the entire structure to be injection moulded in one piece and also improves the load bearing capabilities of the module. Typically, the horizontal compressive strength of the modules is such that they will support a minimum weight of 150 tonnes per square meter. It is preferred that the module is injection moulded in polypropylene or in high or low density polyethylene. However, other suitable materials may be used. The usual embodiment is 250 mm wide×500 nm long as illustrated, and 30 mm deep, although modules might be made in other sizes.

As seen in FIGS. 2 and 3, male engagement means 22 also referred to as locking means, are provided along the ends or side edge areas 26, 28 of two adjacent sides of the module.

Figure 2A:
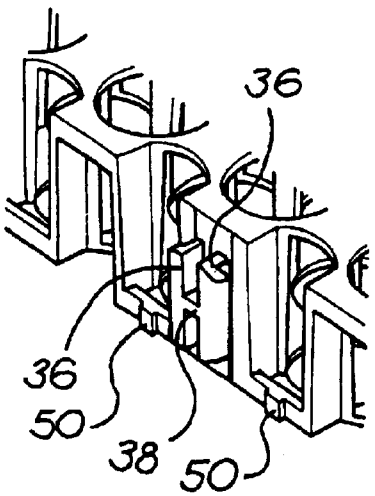
FIG. 2*a* is an enlarged view of a male engagement means of the drainage module.
Figure 5A:
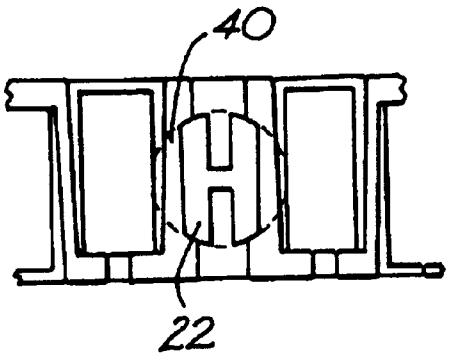
FIG. 5*a* is an enlarged view of a male engagement means of the module.
Figure 5:
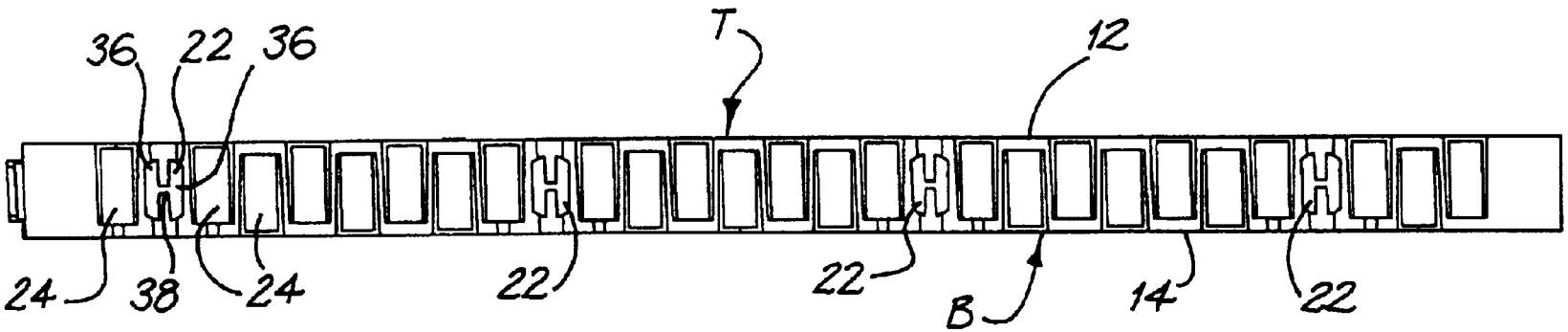
FIG. 5 is a front view of the module of FIG. 2.

As is best seen in FIGS. 2*a* and 5*a*, each of the male engagement means includes two arms 36 which extend outwardly from the side wall in a direction perpendicular to the end wall before bending generally parallel to the end wall so that in plan view (see FIG. 3) each of the arms is generally L shaped. A cross member 38 extends between the two arms of each male engagement means. This cross member assists in preventing the two arms from flexing or twisting.

As can be seen in FIGS. 2 and 3, the male engagement means are equidistantly spaced along the sides 26, 28 of the module. The male engagement means are separated by a series of gaps or spaces 24 in the sides. There are seven gaps between each pair of male engagement means. The gaps are wider than the widest part of the male member.

Also, as is best seen in FIG. 3, the male engagement means are asymmetrically disposed on the sides 26, 28. The reason for this is explained below with reference to the female engagement means 29.

Figure 6:
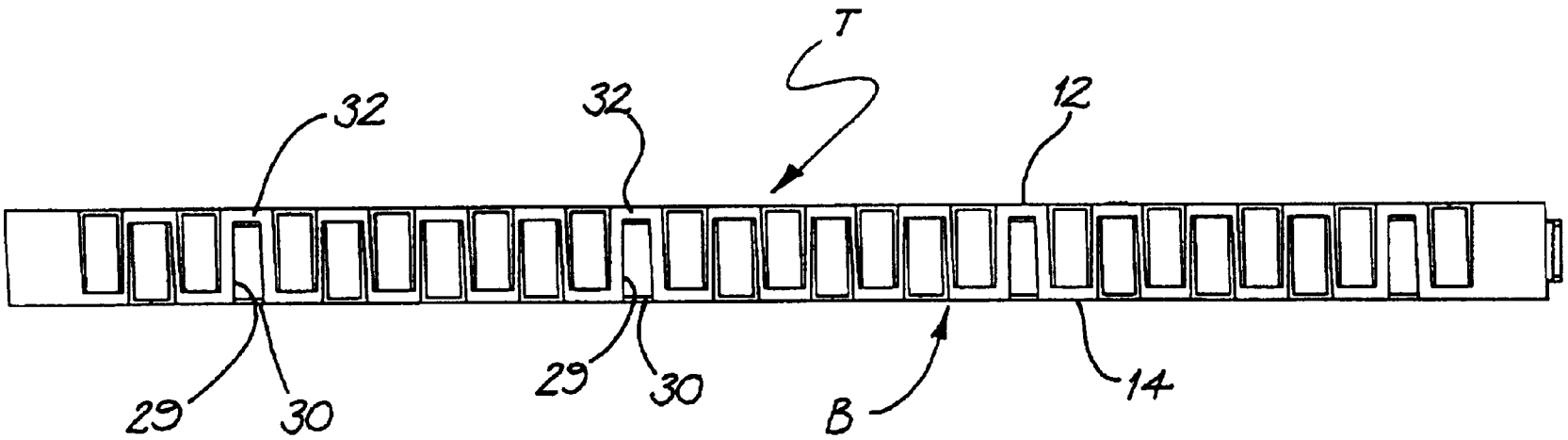
FIG. 6 is a rear view of the module of FIG. 2.
Figure 7:
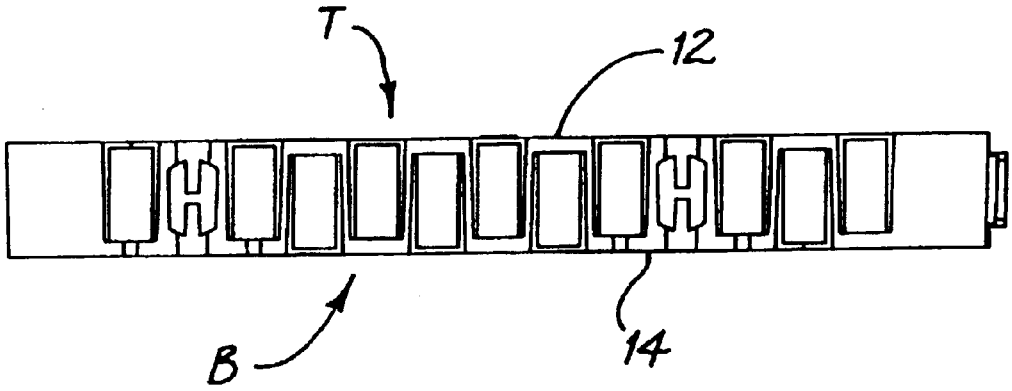
FIG. 7 is a left side view of the module of FIG. 2.
Figure 8:
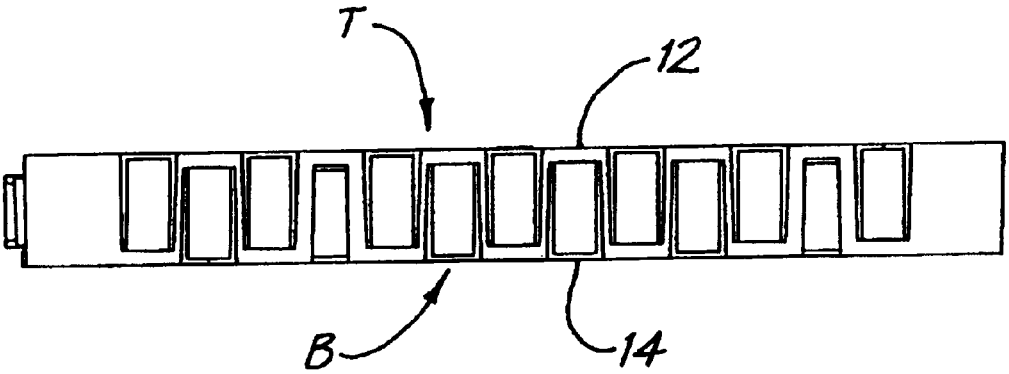
FIG. 8 is a right side view of the module of FIG. 2.

The female engagement means 29 which are best seen in FIGS. 4 and 6 comprise slots having one open end 30 and one closed end 32. Each slot has an shoulder or wall portion 34 extending along its edge.

With reference to FIG. 4, it can be seen that the female engagement means are also asymmetrically arranged on adjacent sides 34, 36 of the module opposite sides 26, 28 respectively. In between the female engagement means, there are seven spaces or gaps 24.

Projections 50 are provided along one bottom edge of the end wall; these help to prevent movement/play between adjacent modules when they are inter-engaged.

When viewed front on, the upper and lower surfaces of the male engagement means are rounded so that the front profile of the male engagement means fits within an imaginary circle 40 as illustrated in FIG. 5*a*. The circle 40 is approximately the same size as the apertures 16, preferably very slightly larger so as to provide an interference push fit with the aperture.

In contrast with existing prior art modules, the described module embodying the present invention, has three distinct modes of interfitting with other modules.

First, when it is desired to interlock two modules 10 in end to end relationship, two modules are located male side face 26 (or 28) to female side face 34 (or 36). The slots of the female engagement means are positioned above the male engagement means and slid down over them. The end portions of the arms of the male engagement means slot behind the shoulders of the female engagement means to engage and lock the two modules together. In this arrangement the modules are butt joined and interlocked.

However, if one of the two modules is turned around through 180° or is flipped over through 180°, the male engagement means abut a gap 26, not a female engagement means (due to the asymmetry of the location of the male and female engagement means on the sides of the module). Then the modules can simply be pushed together. The male engagement means simply locate in a gap 26. In this arrangement the modules are butt joined but not interlocked.

Figure 1:
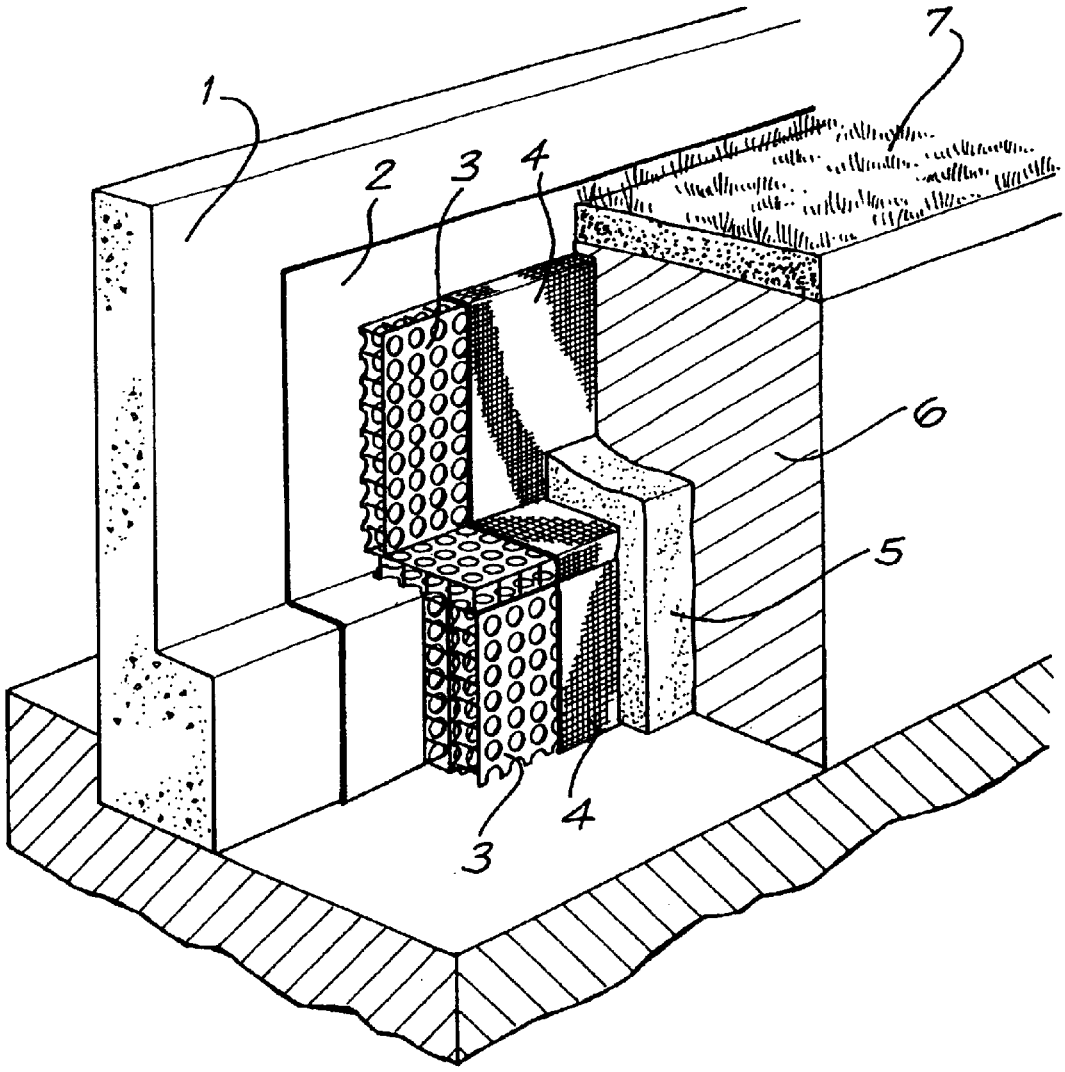
FIG. 1 PRIOR ART
FIG. 1 is a schematic view illustrating one use of a prior art drainage modules.
Figure 9:
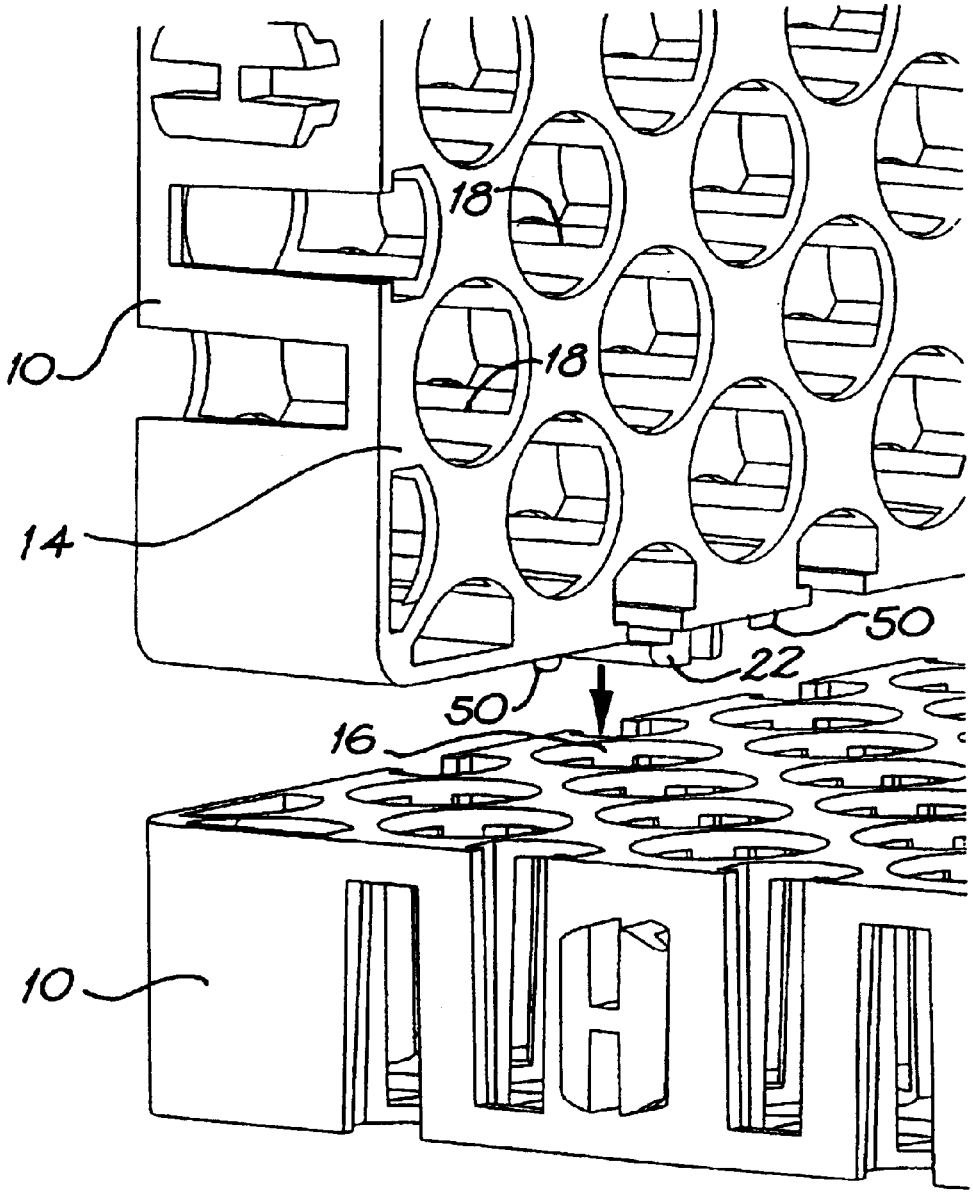
FIG. 9 illustrates interlocking on two modules at 90° to each other.

Also, the modules can be engaged at 90° to each other as illustrated in FIG. 9 with the male engagement means, forming an interference fit in the cylindrical apertures 16 thereby retaining the members together. In this arrangement, the projections 50 should face away from the retaining wall to bias the vertically oriented module against the wall. When installing a drainage module against a retaining wall, such as is illustrated in FIG. 1, the vertically oriented module 3 can thus be simply interlocked with the horizontal module on which it rests.

Also, the modules of the present invention may also be used to form underground storage tanks. It is easier to make a box out of the drainage modules of the present invention than with existing drainage modules of the type which do not engage in both end to end relation and normally to each other. The modules can be interlocked to form a box having no ends. Custom made ends and centre sections, may then be fitted to stabilise and give rigidity to the box and the box may then be covered with a geotextile to form an underground storage tank.

A pattern of small holes, or other markings may be provided on the upper member 12 to indicate which face of the drainage member should face upwards.

The size and shape of the module may be varied from that described. The module may be any shape (e.g. hexagonal). Typically, the modules will be either square or have one side which is a multiple (e.g. 2 times) the length of the other.

Although the above description refers to a drainage module, that is only one use of the structural module of the present invention and other uses, such as those discussed on page 4 of the specification as originally filed, are possible.

The claims defining the invention are as follows:

1. A structural module comprising:

a first and a second substantially parallel generally planar member retained in a fixed spaced relationship from each other by a plurality of spacers extending between the first and second planar members, the module having side edges extending between perimeters of the first and second planar members and wherein each planar member defines an ordered array of apertures:

male interlocking means which are integral with the module projecting from at least a first one of the side edges;

female interlocking means defined in at least a second of the side edges adapted to receive a male interlocking means so that two modules can be secured together in side edge to side edge relation;

characterised in that the size and configuration of the male locking means relative to the size and configuration of the apertures, is such that a first module may also be inter-engaged with a second module, with the first module oriented generally normally to the second module with a side edge of the first module abutting a planar member of the second module and with each male locking means defined along said side edge of the first member extending into one of the apertures defined in one of the planar members in a close or interference type fit with the aperture.

2. A structural module as claimed in claim 1 wherein the female locking means comprise elongate slots defined in side edges of the module.

3. A structural module as claimed in claim 2 wherein the slots have an open end and a closed end.

4. A structural module as claimed in claim 1 wherein the male locking means comprise two arms which are generally L shaped in planar cross section whose distal ends locate behind the side edges adjacent the elongate slot when two modules are interlocked in side edge to side edge relation.

5. A structural module as claimed in claim 1 wherein the apertures are generally circular and the perimeter of the male locking means is also generally circular.

6. A structural module as claimed in claim 1 wherein the area of the apertures comprise at least 50% of the surface area of the first and second planar members.

7. A structural module as claimed in claim 1 wherein the apertures in the planar members are arranged substantially regularly and uniformly.

8. A structural module as claimed in claim 1 wherein the male locking means are equidistantly spaced along a first two adjacent sides of the module.

9. A structural module as claimed in claim 8 wherein the arrangement of male locking means along each adjacent side is asymmetric.

10. A structural module as claimed in claim 9 wherein the female locking means are equidistantly and asymmetrically spaced along the other two sides of the module.

11. A structural module as claimed in claim 1 wherein a series of gaps are also disposed between each pair of female locking means, the gaps being wider than the male members.

12. The use of a module to as claimed in claim 1 to make drainage piping or underground tanks by assembling and interlocking the modules into boxes or pipes and covering them with a geotextile or like material.

13. A tank for use underground comprising modules as claimed in claim 1 assembled into a box structure and covered with a geotextile.

14. Drainage piping for use underground comprising modules as claimed in claim 1 assembled into an elongate open ended box structure and covered with a geotextile.

* * * * *